US005147331A

United States Patent [19]

Rust

[11] Patent Number: 5,147,331

[45] Date of Patent: Sep. 15, 1992

[54] RELEASABLE LOCKING APPARATUS

[76] Inventor: Fred Rust, 2404 Cedar Point Dr., Janesville, Wis. 53546

[21] Appl. No.: 759,394

[22] Filed: Sep. 13, 1991

[51] Int. Cl.[5] ..... E05C 19/08

[52] U.S. Cl. ..... 292/246; 292/205; 292/281; 292/238

[58] Field of Search ..... 292/246, 205, 238, 281, 292/228, 219, 105, 101, 95, 104

[56] References Cited

U.S. PATENT DOCUMENTS

| | | | |
|---|---|---|---|
| 253,976 | 2/1882 | Chandler | 292/128 |
| 388,868 | 9/1888 | Heffener | 292/201 |
| 445,562 | 2/1891 | Legg et al. | 292/205 X |
| 966,792 | 7/1911 | Peterson | 292/104 X |
| 974,323 | 11/1910 | Wheeler | 292/205 X |
| 1,251,207 | 12/1917 | Ferris | 292/104 X |
| 1,514,114 | 11/1924 | Wakefield | 292/205 X |
| 4,986,576 | 1/1991 | Hall | 292/104 |
| 4,986,578 | 1/1991 | Hall | 292/104 |

*Primary Examiner*—Richard E. Moore
*Attorney, Agent, or Firm*—David J. Archer

[57] ABSTRACT

A releasable locking apparatus for securing a closure member to a frame includes a catch plate rigidly secured to the frame, the plate defining a catch. A locking device is pivotally secured to the closure member with the locking means defining an aperture which cooperates with the catch. The arrangement is such that in use of the apparatus, the locking device moves from a first pivotal disposition in which the catch and the aperture are spaced relative to each other to permit movement relative to the frame. The locking means moves to a second disposition in which the catch and the aperture cooperate together so that the locking means rides upon the plate. The locking device moves to a third disposition in which the catch is latchingly disposed within the aperture for securing the closure member to the frame. A backing plate is rigidly secured to the locking device for pivotal movement therewith. The arrangement is such that the closure member is disposed between the backing plate and the locking device. Also, a biasing device bears against the closure member for biasing the locking device from the second disposition to the third disposition thereof for securing the closure to the frame.

11 Claims, 2 Drawing Sheets

RELEASABLE LOCKING APPARATUS

BACKGROUND OF THE INVENTION

1. Field of the Invention

The present invention relates to a releasable locking apparatus for securing a closure member to a frame.

More particularly, the present invention relates to a locking apparatus including a catch plate, a locking device which is pivotally secured to the closure and a backing plate which is rigidly secured to the locking device.

2. Information Disclosure Statement

With the ever increasing rate of vandalism, there exists a need for adequately locking valuable tools within a garden shed or the like. However, typical locks include a hinged locking plate having a hasp which engages a catch plate. Such locking means does not secure a closure to a frame until the hasp engages a staple attached to the frame of the shed and a padlock or the like is secured within the catch to prevent opening of the hasp.

Accordingly, the aforementioned locking means does not provide for an automatically shutting shed door or the like but only provides a means for locking such door.

Also, such prior arrangements make it very easy for a thief to remove such locking means because the hasp plate is usually attached to the closure member by means of a series of screws or the like.

Additionally, relatively complex locking means have been proposed which include spring biased catches such as the "WHITCOMB" latch made by Albany Hardware Specialty Manuf. Co. Inc. of Viroqua Wis. The "Whitcomb" latch includes a bolt type member which slides towards the frame rather than having a "locking means pivotally secured to the closure". Such locks have been relatively costly due to the complexities of manufacture thereof.

The present invention provides a simple means for locking a closure member such as a shed door within a frame. The releasable locking apparatus enables the closure of the door without locking thereof while including a provision for inserting a padlock or the like for preventing unauthorised intrusion into the shed.

Furthermore, the present invention does not include screws or fasteners that would enable a would be intruder to remove the locking means. Therefore, unauthorized access of the shed is inhibited.

Therefore, the primary objective of the present invention is the provision of a releasable locking apparatus which overcomes the aforementioned inadequacies of the prior art locking arrangements and which makes a considerable contribution to the art of securing a closure member to a frame.

Other objects and advantages of the present invention will be readily apparent to those skilled in the art by a consideration of the detailed description contained hereinafter taken in conjunction with the annexed drawings.

SUMMARY OF THE INVENTION

The present invention relates to a releasable locking apparatus for securing a closure member to a frame. The apparatus includes a catch plate which is rigidly secured to the frame. The plate defines a catch. A locking means is pivotally secured to the closure. The locking means defines an aperture which cooperates with the catch. The arrangement is such that in use of the apparatus, the locking means moves from a first pivotal disposition thereof in which the catch and the aperture are spaced relative to each other to permit movement of the closure member relative to the frame. The locking means moves to a second pivotal disposition thereof, in which the catch and aperture cooperate together so that the locking means rides upon the catch. The locking means moves to a third pivotal disposition thereof in which the catch is latchingly disposed within the aperture for securing the closure member to the frame. A backing plate is rigidly secured to the locking means for pivotal movement therewith. The arrangement is such that the closure member is disposed between the backing plate and the locking means.

Biasing means bear against the closure member for biasing the locking means from the second pivotal disposition to the third pivotal disposition for securing the closure member to the frame.

In a more specific embodiment of the present invention, the catch plate also includes a shank portion which defines a plurality of holes.

Additionally, a fastening means cooperates with the plurality of holes for rigidly securing the shank portion to the frame.

Also, a guide portion extends from the shank portion away from the frame. The guide portion defines a cam which cooperates with the aperture for guiding the locking means from the first to the second disposition thereof.

The catch is disposed between the shank portion and the guide portion. The arrangement is such that when the locking means moves from the second to the third disposition thereof, the locking means moves into engagement with the catch.

The apparatus also includes a padlock and the guide portion further defines an orifice that cooperates with the padlock such that when the locking means is in the third disposition thereof with the locking means engaged by the catch, the padlock is inserted through the orifice for locking the locking means relative to the catch plate.

The locking means further includes a base plate having a first and a second portion and a transitional portion which is disposed between the first and second portions. The first portion defines the aperture and the second portion is spaced relative to the closure member.

The transitional portion is angled relative to both the first and the second portion such that the second portion is disposed spaced and parallel relative to the closure member.

The apparatus also includes an anchor pin which is rigidly secured to the closure member.

The first portion also defines a slot that cooperates with the anchor pin for anchoring the locking means relative to the closure member and for permitting pivotal movement of the locking means between the first, second and third pivotal dispositions of the locking means. The slots more particularly, is disposed between the aperture and the transitional portion.

The slot is arcuate and has a center of curvature coaxial with a pivotal axis of the locking means.

The apparatus also includes a handle which is rigidly secured to the second portion for permitting pivotal movement of the locking means between the first, second and third dispositions thereof.

The second portion further includes a bell shaped depression which extends from the second portion to the closure member for stabilizing the locking means. The depression defines an opening which is coaxial with the pivotal axis of the locking means.

The backing plate slides pivotally relative to the closure member and a further handle is rigidly connected to the backing plate.

A further bell shaped depression extends from the backing plate towards the closure member for stabilizing the plate during pivotal movement of the plate relative to the closure member.

The further depression defines a further opening disposed coaxial relative to the pivotal axis of the locking means and the backing plate.

A releasable tie rod extends through the opening, the closure member and the further opening for rigidly connecting the depression and the further depression together so that the locking means and the backing plate pivot together on movement of the locking means between the first, second and third dispositions thereof.

More specifically, the tie rod also includes a cylindrical sleeve which extends from the depression through the closure member to the further depression.

A fastener defines a head and a threaded shank. The fastener extends through the depression and through the sleeve and through the further depression such that the head is located within the depression.

A locking nut cooperates with the threaded shank for clamping the locking means, the backing plate and the sleeve together so that the sleeve is permitted to rotate relative to the closure member when the locking means pivots between the first, second and third dispositions thereof.

In one embodiment of the present invention the biasing means is anchored to the backing plate for urging the backing plate and the locking means away from the second disposition thereof.

In another embodiment of the present invention the biasing means is anchored to the locking means for urging the locking means and the backing plate away from the second disposition of the locking means.

The biasing means is anchored to the locking means and the biasing means extends from the first portion around the depression and back towards a location defined by the closure member such location being disposed adjacent to the first portion.

In another embodiment of the present invention, the biasing means is anchored to the backing plate and extends from the backing plate around the further depression and back towards a further location defined by the closure member such further location being disposed adjacent to the backing plate.

Many variations and modifications of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
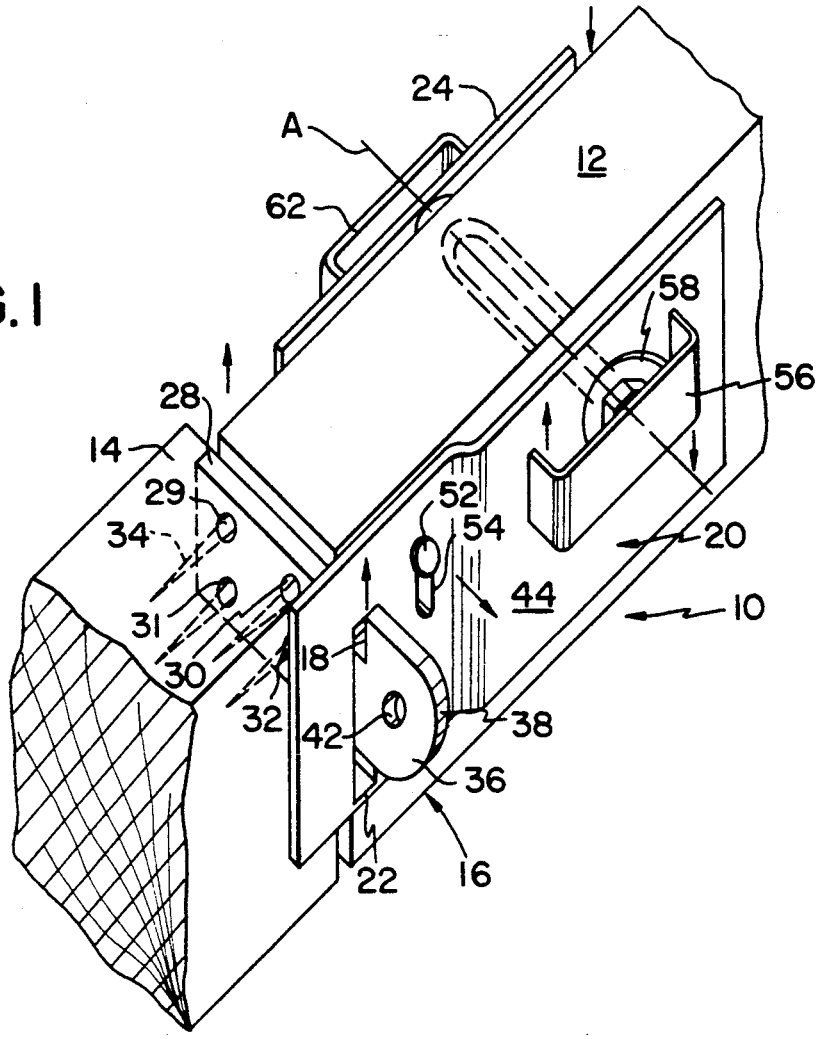
FIG. 1 is a perspective view of a releasable locking apparatus according to the present invention.

FIG. 1 is a perspective view of a releasable locking apparatus generally designated 10 for securing a closure member 12 to a frame 14. The apparatus 10 includes a catch plate generally designated 16 which is rigidly secured to the frame 14. The plate 16 defines a catch 18.

A locking means generally designated 20 is pivotally secured to the closure member 12, the locking means 20 defining an aperture 22 which cooperates with the catch 18. The arrangement is such that in use of the apparatus, the locking means 20 moves from a first pivotal disposition in which the catch 18 and the aperture 22 are spaced relative to each other. To permit closure of the closure member 12 relative to the frame 14, the locking means 20 moves to a second pivotal position in which the catch plate 16 and the aperture 22 cooperate together so that the locking means 20 rides upon the catch plate 16. The locking means 20 moves to a third pivotal disposition in which the catch 18 is latchingly disposed within the aperture 22 for securing the closure member 12 to the frame 14.

Figure 2:
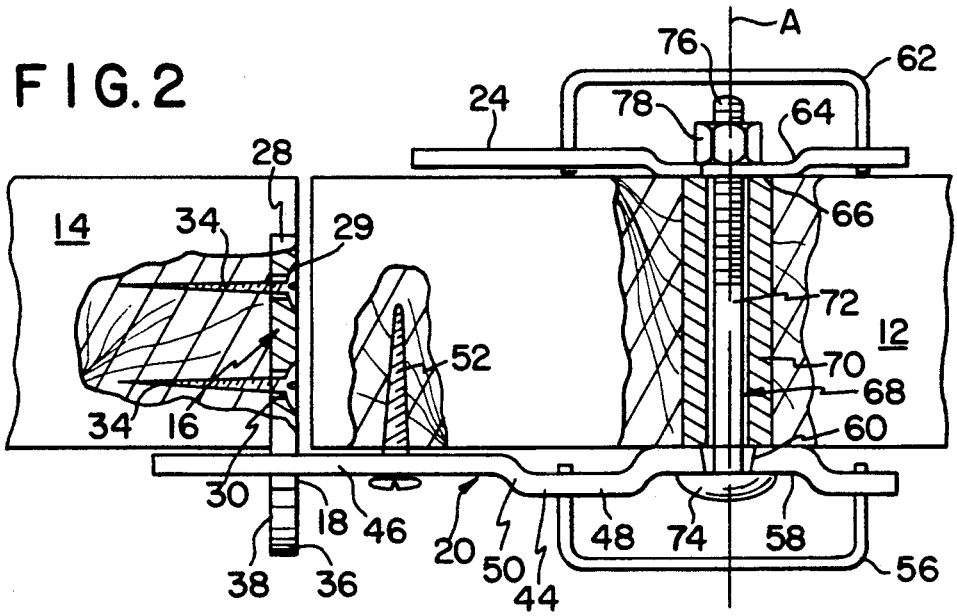
FIG. 2 is a top plan view partially in section of the locking apparatus as shown in FIG. 1.

FIG. 2 is a top plan view of the locking apparatus shown in FIG. 1 and shows a backing plate 24 rigidly secured to the locking means 20 for pivotal movement therewith such that the closure member 12 is disposed between the backing plate 24 and the locking means 20.

Figure 3:
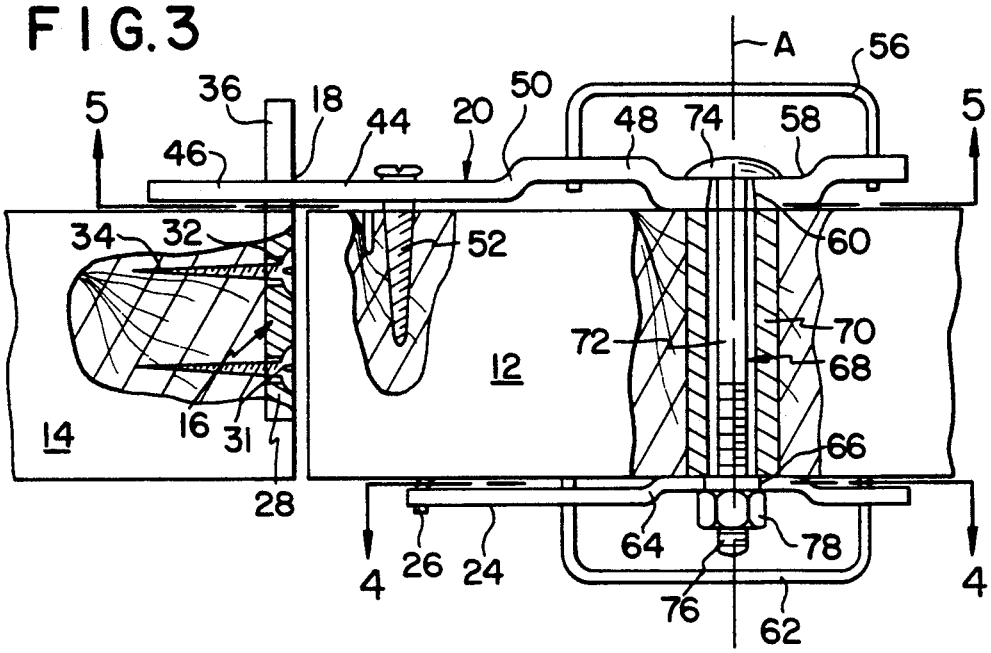
FIG. 3 is a bottom plan view partially in section of the locking apparatus shown in FIG. 1.

FIG. 3 is a bottom plan view of the locking apparatus shown in FIGS. 1 and 2.

Figure 4:
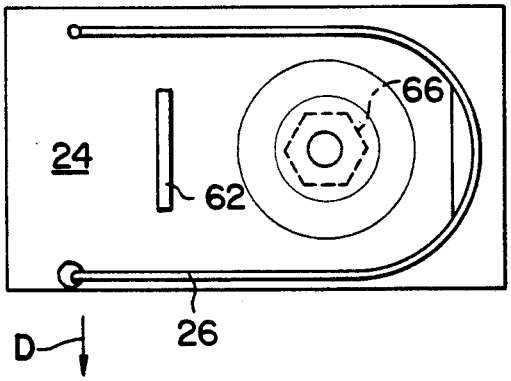
FIG. 4 is a sectional view taken on the line 4—4 of FIG. 3.

FIG. 4 is a sectional view taken on the line 4—4 of FIG. 3 and shows a biasing means 26 which bears against the closure member 12 for biasing the locking means 20 from the second pivotal disposition to the third pivotal disposition for securing the closure member 12 to the frame 14.

Additionally, the catch plate 16 further includes a shank portion 28 which defines a plurality of holes 29,30,31 and 32 as shown in FIG. 1.

Fastening means 34 cooperates with the plurality of holes 29–32 for rigidly securing the shank portion 28 to the frame 14.

A guide porion 36 extends from the shank portion 28 away from the frame 14. The guide portion 36 defines a cam 38 which cooperates with the aperture 22 for guiding the locking means 20 from the first to the second disposition.

The catch 18 is disposed between the shank portion 28 and the guide portion 36. The arrangement is such that when the locking means 20 moves from the second to the third disposition thereof, the locking means 20 moves into engagement with the catch 18.

The apparatus also includes a padlock (not shown) and the guide portion 36 further defines an orifice42 which cooperates with the padlock such that when the locking means 20 is in the third disposition thereof with the locking means 20 engaged by the catch 18, the padlock is inserted through the orifice 42 for locking engagement relative to the catch plate 16.

The locking means 20 also includes a baseplate 44 which has a first and a second portion 46 and 48 respectively. The base plate 44 also has a transitional portion 50 which is disposed between the first portion 46 and the second portion 48 respectivly.

The first portion 46 defines the aperture 22. The second portion 48 is spaced relatively to the closure member 12.

The transitional portion 50 is angled both to the first and the second portions 46 and 48 respectively, such that the second portion 48 is disposed, spaced and parallel relative to the closure member 12.

The apparatus 10 also includes an anchor pin 52 which is rigidly secured to the closure member 12.

The first portion 46 further defines a slot 54 which cooperates with the anchor pin 52 for anchoring the locking means 20 relative to the closure member 12 and for permitting pivotal movement of the locking means 20 between the first, second and third pivotal dispositions of the locking means 20.

The slot 54 is disposed between the aperture 22 and the transitional portion 50. The slot 54 is arcuate and has a center of curvature which is coincident with a pivotal axis A of the locking means 20 as shown in FIG. 1.

The apparatus 10 also includes a handle 56 which is rigidly secured to the second portion 48 for permitting pivotal movement of the locking means 20 between the first, second and third disposition thereof.

The second portion 48 also includes a bell shaped depression 58 which extends from the second portion 48 to the closure member 12 for stabilizing the locking means 20. The depression 58 defines an opening 60 which is coaxial with the pivotal axis A of the locking means 20.

The backing plate 24 is disposed spaced and parallel relative to the first and second portions 46 and 48 respectively. The backing plate 24 slides pivotally relative to the closure member 12.

A further handle 62 is rigidly connected to the backing plate 24.

A further bell shaped depression 64 extends from the backing plate 24 towards the closure member 12 for stabilizing the backing plate 24 during pivotal movement of the plate 24 relative to the closure member 12.

The further depression 64 defines a further opening 66 which is disposed coaxial relative to the pivotal axis A of the locking means 20 and the backing plate 24.

A releasable tie rod generally designated 68 extends through the opening 60, the closure member 12 and the further opening 66 for rigidly connecting the depression 58 and the further depression 64 so that the locking means 20 and the backing plate 24 pivot together on movement of the locking means 20 between the first, second and third dispositions thereof.

More specifically, the tie rod 68 also includes a cylindrical sleeve 70 which extends between the depression 58 through the closure member 12 and through the further depression 64.

A fastener 72 defines a head 74 and a threaded shank 76. The fastener 72 extends through the depression 58 and through the sleeve 70 and through the further depression 64 such that the head 74 is located within the depression 58. The head 74 is preferably smooth so as the prevent unauthorized opening thereof. The fastener 72 is preferably a carriage bolt.

Also, a locking nut 78 cooperates with the threaded shank 76 for clamping the locking means 20, the backing plate 24, and the sleeve 70 together so that the sleeve 70 is permitted to rotate relative to the closure member 12 when the locking means 20 pivots between the first, second and third dispositions thererof.

In a preferred embodiment of the present invention, the sleeve 70 is cut to approximately 1/16th of an inch longer than the thickness of the closure member 12 to permit relative rotation between the sleeve 70 and the closure member 12. Also, the present invention permits application thereto to any closure member thickness.

As shown in FIG. 4 the biasing means 26 is anchored to the backing plate 24 for urging the backing plate 24 and the locking means 20 away from the second dispositon thereof in the direction indicated by the arrow D so that the aperture 22 becomes latched within the catch 18.

Figure 5:
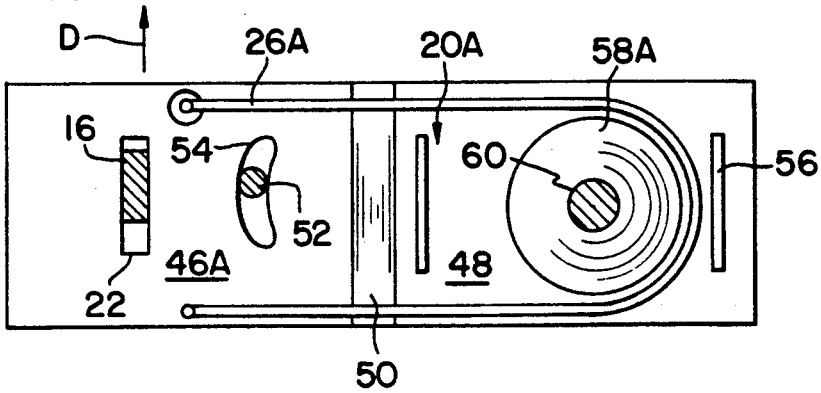
FIG. 5 is a sectional view taken on the line 5—5 of FIG. 3. but showing a different embodiment of the present invention.

In an alternative embodiment of the present invention as shown in FIG. 5 the biasing means 26 is anchored to the locking means 20A for urging the locking means 20A and the backing plate away from the second disposition of the locking means 20A.

More particularly, the biasing means 26 is anchored to the locking means 20A and the biasing means 26 extends from the first portion 46A around the depression 58A and back towards a location defined by the closure member, such location being disposed adjacent to the first portion 46A.

The present invention provides a simple closure member locking device which enables the closure to be readily releasable without locking thereof and inhibits intrusion therein when a padlock is applied thereto.

What is claimed is:

1. A releasable locking apparatus for securing a closure member to a frame, said apparatus comprising:

a catch plate rigidly secured to the frame, said plate defining a catch;

a locking means pivotally secured to the closure, said locking means defining an aperture which co-operates with said catch, the arrangement being such that in use of said apparatus, said locking means moves from a first pivotal disposition in which said catch and said aperture are spaced relative to each other to permit movement of the closure member relative to the frame to a second pivotal disposition in which said catch and said aperture co-operate together so that said locking means rides upon said catch, said locking means moving to a third pivotal disposition in which said catch is latchingly disposed within said aperture for securing the closure member to the frame;

biasing means bearing against the closure member for biasing said locking means from said second pivotal disposition to said third pivotal dispositon for securing the closure member to the frame;

a backing plate rigidly secured to said locking means for pivotal movement therewith, such that the closure member is disposed between said backing plate and said locking means;

said locking apparatus further including:

a base plate having a first and a second portion and a transitional portion disposed between said first and second portions, said first portion defining said aperture;

said second portion being spaced relative to the closure member; and said transitional portion being angled relative to said first and said second portions such that said second portion is disposed spaced and parallel relative to said closure member.

2. A releasable locking apparatus as set forth in claim 1 wherein said catch plate further includes:

a shank portion defining a plurality of holes;

fastening means cooperating with said plurality of holes for rigidly securing said shank portion to the frame;

a guide portion extending from said shank portion away from the frame, said guide portion defining a cam which cooperates with said aperture for guiding said locking means from said first to said second disposition thereof;

said catch being disposed between said shank portion and said guide portion, the arrangement being such that said locking means moves from said second to said third disposition thereof, when said locking means moves into engagement with said catch.

3. A releasable locking apparatus as set forth in claim 1, wherein said apparatus further includes;

an anchor pin rigidly secured to said closure member;

said first portion further defining a slot which cooperates with said anchor pin for anchoring said locking means relative to the closure member and for permitting pivotal movement of said locking means between said first, second and third pivotal dispositions of said locking means.

4. A releasable locking apparatus as set forth in claim 3 wherein said slot is disposed between said aperture and said transitional portion, said slot being arcuate and having a centre of curvature coincident with a pivotal axis of said locking means.

5. A releasable locking apparatus as set forth in claim 1 wherein said apparatus further includes:

a handle rigidly secured to said second portion for permitting pivotal movement of said locking means between said first, second and third dispositions thereof.

6. A releasable locking apparatus as set forth in claim 1 wherein said second portion further includes:

a bell shaped depression extending from said second portion to said closure member for stabilizing said locking means, said depression defining an opening which is coaxial with the pivotal axis of said locking means.

7. A releasablable locking apparatus as set forth in claim 6, wherein said backing plate is disposed parallel and spaced relative to said closure member;

a further handle rigidly connected to said backing plate;

a further bell shaped depression extending from said backing plate towards the closure member for stabilizing said backing plate during pivotal movement of said backing plate;

said further depression defining a further opening disposed coaxial relative to the pivotal axis of said locking means and said backing plate;

a releasable tie rod extending through said opening, said closure member and said further opening for rigidly connecting said depression and said further depression together so that said locking means and said backing plate pivot together on movement of said locking means between said first, second and said third dispositions thereof.

8. A releasable locking apparatus as set forth in claim 7 wherein said tie rod further includes:

a cylindrical sleeve entending from said depression through the closure member to said further depression;

a fastener defining a head and a threaded shank, said fastener extending through said depression and through said sleeve and through said further depression such that said head is located within said depression;

a locking nut cooperating with said threaded shank for clamping said locking means, said backing plate and said sleeve together so that said sleeve is permitted to rotate relative to the closure member when said locking means pivots between said first, second and third dispositions thereof.

9. A releasable locking apparatus for securing a closure member to a frame, said apparatus comprising:

a catch plate rigidly secured to the frame, said plate defining a catch;

a locking means pivotally secured to the closure, said locking means defining an aperture which co-operates with said catch, the arrangement being such that in use of said apparatus, said locking means moves from a first pivotal disposition in which said catch and said aperture are spaced relative to each other to permit movement of the closure member relative to the frame to a second pivotal disposition in which said catch and said aperture co-operate together so that said locking means rides upon said catch, said locking means moving to a third pivotal disposition in which said catch is latchingly disposed within said aperture for securing the closure member to the frame;

biasing means bearing against the closure member for biasing said locking means from said second pivotal disposition to said third pivotal disposition for securing the closure member to the frame;

a backing plate rigidly secured to said locking means for pivotal movement therewith, such that the closure member is disposed between said backing plate and said locking means;

said biasing means being anchored to said backing plate for urging said backing plate and said locking means away from said second disposition thereof.

10. A releasable locking apparatus as set forth in claim 6 wherein said biasing means is anchored to said locking means, said biasing means extending from said first portion around said depression and back towards a location defined by said closure member such location being disposed adjacent to said first portion.

11. A releasable locking apparatus as set forth in claim 7 wherein said biasing means is anchored to said backing plate, said biasing means extending from said backing plate around said further depressing and back towards a further location defined by the closure member.

* * * * *